US006254695B1

(12) United States Patent
Herzer et al.

(10) Patent No.: US 6,254,695 B1
(45) Date of Patent: Jul. 3, 2001

(54) METHOD EMPLOYING TENSION CONTROL AND LOWER-COST ALLOY COMPOSITION ANNEALING AMORPHOUS ALLOYS WITH SHORTER ANNEALING TIME

(75) Inventors: Giselher Herzer, Bruchkoebel; Robert Schulz, Frankfurt, both of (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/133,172

(22) Filed: Aug. 13, 1998

(51) Int. Cl.[7] ..... H01F 1/153
(52) U.S. Cl. ..... 148/108; 148/120
(58) Field of Search ..... 148/108, 120, 148/121

(56) References Cited

U.S. PATENT DOCUMENTS

| | | | | |
|---|---|---|---|---|
| 3,820,040 | | 6/1974 | Berry et al. . | |
| 4,437,907 | * | 3/1984 | Sato et al. | 148/121 |
| 5,469,140 | | 11/1995 | Liu et al. . | |
| 5,628,840 | * | 5/1997 | Hasegawa | 148/304 |
| 5,676,767 | | 10/1997 | Liu et al. . | |
| 5,728,237 | | 3/1998 | Herzer . | |
| 5,757,272 | * | 5/1998 | Herzer | 340/572 |
| 5,841,348 | | 11/1998 | Herzer . | |
| 6,011,475 | | 1/2000 | Herzer . | |
| 6,018,296 | | 1/2000 | Herzer . | |

FOREIGN PATENT DOCUMENTS

| | | |
|---|---|---|
| 9412456 | 5/1995 | (DE) . |
| 0 093 281 | 11/1983 | (EP) . |
| WO 90/03652 | 4/1990 | (WO) . |
| WO 96/32518 | 10/1996 | (WO) . |
| WO 97/13258 | 4/1997 | (WO) . |
| WO 99/10899 | 3/1999 | (WO) . |

OTHER PUBLICATIONS

"*Magnetomechanical Properties of Amorphous Meals*", Livingston J.D. 1982, phys. stat. sol. (a) vol. 70, pp. 591–596.

"*Magnetomechanical damping in amorphous ribbons with uniaxial anisotropy*," Herzer, G. (1997), Materials Science and Engineering A226–228, pp. 631.

"*Effects of Longitudinal and Torsional Stress Annealing on the Magnetic Anisotropy in Amorphous Ribbon Materials*," Nielsen O., 1985, IEEE Transactions on Magnetics, vol. Mag–21, No. 5 pp. 2008–2013.

"*Stress Induced Anisotropy in a Non–Magnetostrictive Amorphous Alloy*," Hilzinger H. R., 1981, Proc. 4th Int. Conf. On Rapidly Quenched Metals (Sendai 1981), pp. 791).

"*Magnetic Anisotropy*" H. Fujimori in Luborsky (ed) *Amorphous Metallic Alloys*, (1983) pp. 300–316.

* cited by examiner

*Primary Examiner*—John Sheehan
(74) *Attorney, Agent, or Firm*—Schiff Hardin & Waite

(57) ABSTRACT

A ferromagnetic resonator for use in a marker in a magnetomechanical electronic article surveillance system has improved properties and can be manufactured at higher annealing speeds and reduced raw material cost by virtue of being continuously annealed in the simultaneous presence of a magnetic field perpendicular to the ribbon axis and a tensile stress applied along the ribbon axis and by providing an amorphous magnetic alloy containing iron, cobalt and nickel in which the portion of iron is more than about 15 at % and less than about 30 at %.

34 Claims, 2 Drawing Sheets

METHOD EMPLOYING TENSION CONTROL AND LOWER-COST ALLOY COMPOSITION ANNEALING AMORPHOUS ALLOYS WITH SHORTER ANNEALING TIME

BACKGROUND OF THE INVENTION

1. Field of the Invention

The present invention relates to magnetic amorphous alloys and to a method for annealing these alloys in a magnetic field simultaneously applying a tensile stress. The present invention is also directed to making amorphous magnetostrictive alloys for use in a marker in a magnetomechanical electronic article surveillance or identification.

2. Description of the Prior Art

U.S. Pat. No. 5,820,040 teaches that transverse field annealing of amorphous iron based metals yields a large change of Young's modulus with an applied magnetic field and that this effect provides a useful means to achieve control of the vibrational frequency of an electromechanical resonator with the help of an applied magnetic field.

The possibility to control the vibrational frequency by an applied magnetic field described in European Application 0 093 281 as being particularly useful for markers for use in electronic article surveillance. The magnetic field for this purpose is produced by a magnetized ferromagnetic strip (bias magnet) disposed adjacent to the magnetoelastic resonator, with the strip and the resonator being contained in a marker or tag housing. The change in effective permeability of the marker at the resonant frequency provides the marker with signal identity. This signal identity can be removed by changing the resonant frequency by changing the applied field. Thus, the marker, for example, can be activated by magnetizing the bias strip and, correspondingly, can be deactivated by degaussing the bias magnet which removes the applied magnetic field and thus changes the resonant frequency appreciably. Such systems originally (cf. European Application 0 0923 281 and PCT Application WO 90/03652) used markers made of amorphous ribbons in the as prepared state which also can exhibit an appreciable change of Young's modulus with an applied magnetic field owing to uniaxial anisotropies associated with production-inherent mechanical stresses.

U.S. Pat. No. 5,469,140 discloses that the application of transverse field annealed amorphous magnetomechanical elements in electronic article surveillance systems removes a number of deficiencies associated with the markers of the prior art which use "as prepared" amorphous material. One reason is that the linear hysteresis loop associated with the transverse field annealing avoids the generation of harmonics which can produce undesirable alarms in other types of EAS systems (i.e. harmonic systems). Another advantage of such annealed resonators is their higher resonant amplitude. A further advantage is that the heat treatment in a magnetic field significantly improves the consistency in terms of the resonant frequency of the magnetostrictive strips.

As, for example, explained by Livingston J. D. 1982, *"Magnetomechanical Properties of Amorphous Metals"*, phys. stat. sol. (a) vol 70, pp 591–596 or by Herzer, G. (1997), *Magnetomechanical damping in amorphous ribbons with uniaxial anisotropy,* Materials Science and Engineering A226–228, pp. 631, the resonator properties, such as resonant frequency, the amplitude or the ring-down time are largely determined by the saturation magnetostriction and the strength of the induced anisotropy. Both quantities strongly depend on the alloy composition. The induced anisotropy additionally depends on the annealing conditions i.e. on annealing time and temperature and a tensile stress applied during annealing (cf. Fujimori H., 1983 *"Magnetic Anisotropy"* in F. E. Luborsky (ed) *Amorphous Metallic Alloys,* Butterworths, London, pp. 300–316 and references therein, Nielsen O., 1985, *Effects of Longitudinal and Torsional Stress Annealing on the Magnetic Anisotropy in Amorphous Ribbon Materials,* IEEE Transactions on Magnetics, vol Mag-21, No 5, Hilzinger H. R., 1981, *Stress Induced Anisotropy in a Non-Magnetostrictive Amorphous Alloy,* Proc. 4th Int. Conf. On Rapidly Quenched Metals (Sendai 1981), pp. 791). Consequently, the resonator properties depend strongly on these parameters.

Accordingly, aforementioned U.S. Pat. No. 5,469,140 teaches that a preferred material is an Fe—Co-based alloy with at least about 30 at % Co. The high Co-content according to this patent is necessary to maintain a relatively long ring-down period of the signal. In German Gebrauchsmuster G 94 12 456.6 it was recognized that a long ring down time is achieved by choosing an alloy composition which reveals a relatively high induced magnetic anisotropy and, that, therefore, such alloys are particularly suited for EAS markers. This Gebrauchsmuster teaches that this can also be achieved at lower Co-contents if, starting from a Fe—Co-based alloy, up to about 50% of the iron and/or cobalt is substituted by nickel. U.S. Pat. No. 5,728,237 discloses further compositions with Co-content lower than 23 at % which are characterized by a small change of the resonant frequency and the resulting signal amplitude due to changes in the orientation of the marker in the earth's magnetic field and which at the same time are reliably deactivatable. The need for a linear loop with relatively high anisotropy and the benefit of alloying Ni in order to reduce the Co-content for such magnetoelastic markers was reconfirmed by the disclosure of U.S. Pat. No. 5,628,840 which teaches that alloys with an iron content of at least 30 at % and below about 45 at % are particularly suited.

The field annealing in the aforementioned examples was done across the ribbon width i.e. the magnetic field direction was oriented perpendicularly to the ribbon axis and in the plane of the ribbon surface. This technique will be referred to as transverse field-annealing. The strength of the magnetic field has to be strong enough in order to saturate the ribbon ferromagnetically across the ribbon width. This can be already achieved in magnetic fields of a few hundred Oe. U.S. Pat. No. 5,469,140, for example, teaches a field strength in excess of 500 Oe or 800 Oe, respectively; similarly PCT Application WO 96/32518 discloses a field strength of about 1 kOe to 1.5 kOe. Such transverse field-annealing can be performed, for example, batch-wise either on toroidally wound cores or on pre-cut straight ribbon strips. Alternatively and as disclosed in detail in European Patent Application 0 737 986 corresponding to (U.S. Pat. No. 5,676,767), the annealing can be advantageously performed in a continuous mode by transporting the alloy ribbon from one reel to another reel through an oven in which a transverse saturating field is applied to the ribbon.

Typical annealing conditions disclosed in aforementioned patents are annealing temperatures from about 300° C. to 400° C.; annealing times from several seconds up to several hours. PCT Application WO 97/13258, for example, teaches annealing speeds from about 0.3 m/min up to 12 m/min for a 1.8 m long furnace.

Aforementioned PCT Application WO 96/32518 also discloses that a tensile stress ranging from about zero to about 70 MPa can be applied during annealing. The result of this tensile stress is that the resonator amplitude and the frequency slope $|df_r/dH|$ either slightly increases, remains unchanged or slightly decreases, i.e., there was no obvious advantage or disadvantage for the resonator properties when applying a tensile stress limited to a maximum of about 70 MPa.

It is well known (cf. the aforementioned Nielsen article and Hilzinger article) that a tensile stress applied during annealing induces a magnetic anisotropy. The magnitude of this anisotropy is proportional to the magnitude of the applied stress and depends on the annealing temperature, the annealing time and the alloy composition. The anisotropy orientation corresponds either to a magnetic easy ribbon axis or a magnetic hard ribbon axis (the easy magnetic plane being perpendicular to the ribbon axis) and thus either decreases or increases the field induced anisotropy depending on the alloy composition.

The fingerprint of the aforementioned markers, as well as for other magneto-acoustic markers used e.g. in identification systems is their resonant frequency at a given bias field.

One problem is that the resonant frequency can be subject to changes due to the orientation of the marker in the earth's magnetic field and/or due to scatter in the bias magnet's properties. Thus, for aforementioned EAS markers, it is highly desirable that the resonant frequency $f_r$ in the activated state (i.e. when the bias magnet is magnetized) varies as little as possible with the applied magnetic field H—a typical requirement e.g. is $|df_r/dH|<700$ Hz/Oe. This requires a relatively high magnetically induced anisotropy which can be only achieved when the resonator alloy contains an appreciable amount of Co and/or is annealed at relatively low annealing speeds. However, because of the high raw material cost of cobalt, it is highly desirable to reduce its content in the alloy. High annealing speeds are a further requirement to reduce production and investment cost.

Another problem is that the resonant frequency at a given bias and the change of the resonant frequency with the bias field are highly sensitive to a variety of parameters. Apart form the length and the width of the resonator, these parameters include the chemical composition, the thickness of the resonator and the time and temperature of the heat treatment. Thus, in order to guarantee reproducible resonator properties from batch to batch a composition must be reproduced with an accuracy beyond the capability of chemical analysis. Similarly, in order to guarantee reproducible resonator properties within one batch thickness fluctuations must be restricted to less than ±1 $\mu$m, which is at the limit or even beyond the limit of current manufacturing technology. Finally, reproducible properties require a most precise control of the annealing temperature and annealing time which both sensitively influence the resonator properties. Clearly these circumstances require most narrow tolerances in the whole manufacturing line, limit the production yield and, thus, enhance manufacturing cost significantly.

SUMMARY OF THE INVENTION

According to the state of the art discussed above, it is highly desirable to reduce the Co-content of amorphous magneto-acoustic resonators even further, to increase the annealing speed even more and/or to allow broader range tolerances in the manufacturing line without degrading the consistency of the properties of the final resonator. The present inventors have recognized that all these needs can be achieved by choosing an appropriate alloy composition and by additionally applying a controlled tensile stress along the ribbon during magnetic field annealing.

It is an object of this invention to provide a method of annealing for amorphous ferromagnetic alloys which allows annealing at higher speeds and to provide alloy compositions suitable for this process with reduced raw material costs.

It is a further object of this invention to provide a method of annealing where the annealing parameters, in particular the tensile stress, are adjusted in a feed-back process to obtain a high consistency in the magnetic properties of the annealed amorphous ribbon.

More specifically it is an object of the present invention to provide a magnetostrictive alloy and a method of annealing the same, in order to produce a resonator having properties suitable for use in electronic article surveillance at lower raw material cost, at a higher annealing speed, better consistency and/or better performance than conventional resonators.

It is another object of this invention to provide such a magnetostrictive amorphous metal alloy for incorporation in a marker in a magnetomechanical surveillance system which can be cut into an oblong, ductile, magnetostrictive strip which can be activated and deactivated by applying or removing a pre-magnetization field H and which in the activated condition can be excited by an alternating magnetic field so as to exhibit longitudinal, mechanical resonance oscillations at a resonance frequency $f_r$ which after excitation are of high signal amplitude.

It is a further object of this invention to provide such an alloy wherein only a slight change in the resonant frequency occurs given a change in the bias field but wherein the resonant frequency changes significantly when the marker resonator is switched from an activated condition to a deactivated condition.

Another object of the present invention is to provide such an alloy which, when incorporated in a marker for magnetomechanical surveillance system, does not trigger alarm in a harmonic surveillance system.

It is also an object of this invention to provide a marker embodying such a resonator, and a method for making a marker suitable for use in a magnetomechanical surveillance system.

It is finally an object of this invention to provide a magnetomechanical electronic article surveillance system which is operable with a marker having a resonator composed of such an amorphous magnetostrictive alloy.

The above objects are achieved when the amorphous magnetostrictive alloy is continuously annealed in a magnetic field perpendicular to the ribbon axis with a simultaneously applied tensile stress of typically between about 20 MPa up to about 400 MPa, applied along the ribbon axis. The alloy composition has to be chosen such that the tensile stress applied during annealing induces a magnetic hard ribbon axis, i.e., a magnetic easy plane perpendicular to the ribbon axis. This anisotropy adds to the anisotropy induced by magnetic field annealing. This results in achievement of the same magnitude of induced anisotropy which, without applying the tensile stress, would only be possible at larger Co-contents and/or slower annealing speeds. Thus the inventive annealing is capable of producing magnetoelastic resonators at lower raw material and lower annealing costs than is possible with the techniques of the prior art.

For this purpose it is advantageous to choose an Fe—Ni—Co-base alloy with an iron content of more than about 15 at % and less than about 30 at %. A generalized formula for the alloy compositions which, when annealed as described above, produces a resonator having suitable properties for use in a marker in a electronic article surveillance or identification system, is as follows, $Fe_aCo_bNi_cSi_xB_yM_z$ wherein a, b, c, x, y and z are in at %, wherein M is one or more glass formation promoting elements such as C, P, Ge, Nb, Ta and/or Mo and/or one or more transition metals such as Cr and/or Mn and wherein $15 \leqq a \leqq 30$ $0 \leqq b \leqq 30$ $15 \leqq c \leqq 55$ $0 \leqq x \leqq 10$ $10 \leqq y \leqq 25$ $0 \leqq z \leqq 5$ $14 \leqq x+y+z \leqq 25$ such that a+b+c+x+y+z=100.

The desired objects of the invention can be realized in a particularly advantageous way by applying the following ranges to the above formula:

$15 \leqq a \leqq 30$ $5 \leqq b \leqq 18$ $32 \leqq c \leqq 52$ $0 \leqq x \leqq 6$ $12 \leqq y \leqq 18$ $0 \leqq z \leqq 3$ $14 < x+y+z < 20$ such that a+b+c+x+y+z=100.

Examples for such particularly suited alloys for EAS applications are $Fe_{24}Co_{16}Ni_{42.5}Si_{1.5}B_{15.5}C_{0.5}$, $Fe_{24}Co_{15}Ni_{43.5}Si_{1.5}B_{15.5}C_{0.5}$, $Fe_{24}Co_{14}Ni_{44.5}Si_{1.5}B_{15.5}C_{0.5}$, $Fe_{24}Co_{13}Ni_{46}Si_1B_{15.5}C_{0.5}$ and $Fe_{25}Co_{10}Ni_{48}Si_1B_{15.5}C_{0.5}$.

Such alloy compositions are characterized by an increase of the induced anisotropy field $H_k$ when a tensile stress is a applied during annealing. This increase of $H_k$ depends essentially linearly on the annealing stress and, typically, is at least about 1 Oe (in many cases at least about 2 Oe), when the annealing stress is increased by 100 MPa and when the ribbon is annealed for at least about a few seconds at an annealing temperature being within the range from about 340° to about 420° C.

As an example, for a 6 mm wide and 25 $\mu$m thick ribbon, using such a composition in combination with an anneal treatment under a tensile stress of at least about 100 MPa allows the Co-content to be reduced by about 3–5 at % compared to an identical heat treatment but without tensile stress. The Co-content can be even further reduced up to about 10 at % when the tensile stress is increased to about 200–300 MPa.

The suitable alloy compositions have a saturation magnetostriction of more than about 3 ppm and less than about 15 ppm. Particularly suited resonators, when annealed as described above, have an anisotropy field $H_k$ between about 5 Oe and 13 Oe, where $H_k$ should be chosen lower as the saturation magnetostriction is lowered and increased as the saturation magnetostriction increases. These anisotropy field strengths are low enough to provide the advantage that the maximum resonant amplitude is located at a bias smaller than about 8 Oe which e.g. reduces the material cost for the bias magnet. On the other hand these anisotropy fields are high enough such that the active resonators exhibit only a relatively slight change in the resonant frequency $f_r$ given a change in the magnetization field strength i.e. $|df/dH|<700$ Hz/Oe, but at the same time the resonant frequency $f_r$ changes significantly, by at least about 1.6 kHz, when the marker resonator is switched from an activated condition to a deactivated condition. In a preferred embodiment such a resonator ribbon has a thickness less than about 30 $\mu$m, a length of about 35 mm to 40 mm and a width less then about 13 mm, preferably between about 4 mm to 8 mm i.e., for example, 6 mm.

The annealing process results in a hysteresis loop which is linear up to the magnetic field where the magnetic alloy is saturated ferromagnetically. As a consequence, when excited in an alternating field the material produces virtually no harmonics, and thus does not trigger alarm in a harmonic surveillance system.

The variation of the induced anisotropy and the corresponding variation of the magneto-acoustic properties with tensile stress can also be advantageously used to control the annealing process. For this purpose the magnetic properties (e.g. the anisotropy field, the permeability or the speed of sound at a given bias) are measured after the ribbon has passed the furnace. During the measurement the ribbon should be under a pre-defined stress or preferably stress free which, can be achieved by a dead loop. The result of this measurement may be corrected to incorporate the demagnetizing effects as they occur on the short resonator. If the resulting test parameter deviates from its pre-determined value, the tension is increased or decreased to yield the desired magnetic properties. This feedback system is able to effectively compensate the influence of composition fluctuations, thickness fluctuations and deviations from the annealing time and temperature on the magnetic and magnetoelastic properties. This results in extremely consistent and reproducible properties of the annealed ribbon, which otherwise are subject to relatively strong fluctuations due to the aforementioned influence parameters.

This tension controlled annealing is preferably done under an average pre-stress of at least about 80 MPa which allows to correct for "plus/minus" fluctuations. Typically it needs about ±20 to 50 MPa to correct for the fluctuations of alloy composition, thickness and annealing parameters. The tensile stress should be lower than the yield strength of the material and therefore should not exceed about 1000 MPa. Even more preferably it should not exceed about 400 MPa in order to avoid unwanted breaks e.g. due to local defects of the ribbon.

Of course, such a tension controlled feedback system is not limited to the case where the tensile stress produces a magnetic hard ribbon axis but works as well if the stress induced anisotropy results in a magnetic easy ribbon axis. What is important is that the tensile stress induces a large change of the total anisotropy. This can also be the case if the iron content of the alloy exceeds about 45 at %. Although these alloys are less suited for the aforementioned EAS systems, they may be well suited for magnetoelastic identification systems which the capability of producing require a large change of Young's modulus with the applied field (i.e. a large value of dfr/dH) and correspondingly a small anisotropy field. Thus in this particular case it is advantageous to have an alloy composition where stress annealing results in a magnetic easy ribbon axis.

A generalized formula for the alloy compositions which, when annealed as described above, produce a resonator having suitable properties for use as a resonator incorporated, in a housing together with a bias magnet, and /or further resonators as a marker or tag in a electronic article identification system, is as follows, $$Fe_aCo_bNi_cSi_xB_yM_z$$

wherein a, b, c, x, y and z are in at %, wherein M is one or more glass formation promoting element such as C, P, Ge, Nb, Ta and/or Mo and/or one or more transition metals such as Cr and/or Mn and wherein $$45<a<86$$

$$0<b<40$$

$$0<c<50$$

$$0\leqq x\leqq 10$$

$$10\leqq y\leqq 25$$

$$0\leqq z\leqq 5$$

$$14\leqq x+y+z\leqq 25$$

such that a+b+c+x+y+z=100.

DESCRIPTION OF THE PREFERRED EMBODIMENTS

Alloy Preparation

Figure 1:
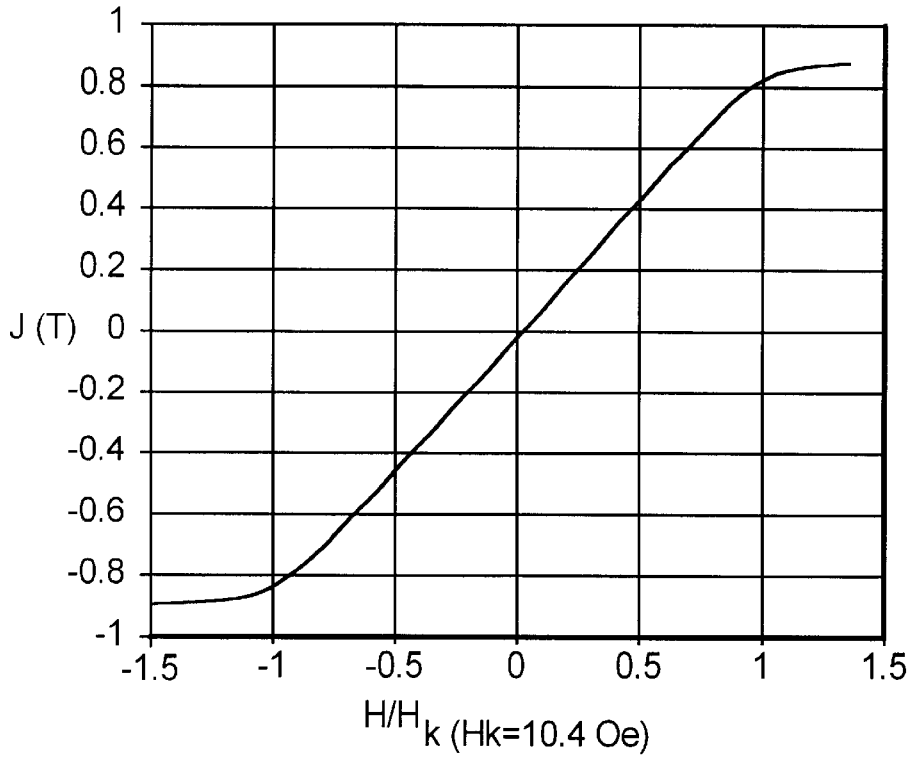
FIG. 1 shows a typical hysteresis loop for an amorphous ribbon annealed in a magnetic field oriented perpendicularly to the ribbon axis, or annealed under the simultaneous presence of such a magnetic field with a tensile stress along the ribbon axis.

Amorphous metal alloys within the Fe—Co—Ni—Si—B system were prepared by rapidly quenching from the melt as thin ribbons typically 25 $\mu$m thick. Table I lists typical examples of the investigated compositions and their properties. The compositions are nominal only and the individual concentrations may deviate slightly from this nominal values and the alloy may contain impurities like carbon due to the melting process and the purity of the raw materials.

In Table I, $\lambda_s$ is the saturation magnetostriction and $J_s$ is the saturation polarization in the as prepared state. $H_k(0)$ is the anisotropy field and $|df_r/dH|$ is the slope at the maximum resonant amplitude for a 38 mm long, 6 mm wide (typically 25 $\mu$m thick) resonator cut from a ribbon continuously annealed without tensile stress for about 6 s at 360° C. in a magnetic field of 2.8 kOe strength oriented perpendicularly to the ribbon axis and essentially perpendicular to the ribbon plane. $|dH_k/d\sigma|$ denotes the change of the anisotropy field with a tensile stress $\sigma$ applied during annealing at the designated annealing conditions. $\sigma$ is the tensile stress needed to give the strip a anisotropy field $H_k(\sigma)$ such that the slope $|df_r/dH|$ at the bias $H_{max}$ where the resonant amplitude is maximum becomes about 650 Hz/Oe. Alloys 1 through 15 are inventive examples useful for EAS applications which operate at a fixed bias field. Alloys 22 through 24 are inventive examples useful for ID systems which require a high-frequency slope. Alloys 16 through 21 are comparative examples outside the scope of this invention.

TABLE I

| Nr. | Alloy Composition (at %) | $\lambda_s$ (ppm) | $J_s$ (T) | $H_k(0)$ (Oe) | $\lvert df_r/dH\rvert$ (Hz/Oe) | $dH_k/d\sigma$ (Oe/MPa) | $\sigma$ (MPa) | $H_k(\sigma)$ (Oe) | $H_{max}$ (Oe) |
|---|---|---|---|---|---|---|---|---|---|
| 1 | $Fe_{27}Co_8Ni_{47}Si_2B_{16}$ | 11.6 | 0.86 | 5.3 | 2890 | 0.020 | 310 | 11.6 | 7.6 |
| 2 | $Fe_{22}Co_{10}Ni_{50}Si_2B_{16}$ | 10.1 | 0.80 | 3.6 | 4920 | 0.028 | 255 | 10.7 | 6.9 |
| 3 | $Fe_{27}Co_{10}Ni_{45}Si_2B_{16}$ | 11.3 | 0.91 | 6.6 | 1740 | 0.020 | 228 | 11.1 | 7.2 |
| 4 | $Fe_{24}Co_{14}Ni_{44.5}Si_{1.5}B_{16}$ | 11.6 | 0.91 | 8.1 | 1260 | 0.023 | 146 | 11.4 | 7.4 |
| 5 | $Fe_{22}Co_{15}Ni_{45}Si_2B_{16}$ | 10.1 | 0.87 | 7.3 | 1270 | 0.026 | 118 | 10.3 | 6.7 |
| 6 | $Fe_{24}Co_{15}Ni_{43.5}Si_{1.5}B_{16}$ | 11.9 | 0.93 | 9.1 | 1010 | 0.022 | 105 | 11.5 | 7.5 |
| 7 | $Fe_{24}Co_{16}Ni_{42}Si_2B_{16}$ | 11.3 | 0.92 | 9.7 | 840 | 0.023 | 61 | 11.1 | 7.2 |
| 8 | $Fe_{28}Co_{16}Ni_{38}Si_2B_{16}$ | 13.5 | 1.00 | 10.0 | 990 | 0.015 | 165 | 12.4 | 8.1 |
| 9 | $Fe_{24}Co_{18}Ni_{40}Si_2B_{16}$ | 11.7 | 0.95 | 10.8 | 710 | 0.023 | 20 | 11.2 | 7.3 |
| 10 | $Fe_{17}Co_{20}Ni_{46}Si_1B_{16}$ | 5.6 | 0.79 | 6.3 | 700 | 0.030 | 8 | 6.5 | 4.2 |
| 11 | $Fe_{22}Co_{20}Ni_{40}Si_2B_{16}$ | 10.4 | 0.93 | 10.6 | 610 | 0.025 | 0 | 10.6 | 6.9 |
| 12 | $Fe_{24}Co_{20}Ni_{38}Si_2B_{16}$ | 11.8 | 0.98 | 11.3 | 630 | 0.020 | 0 | 11.3 | 7.4 |
| 13 | $Fe_{24}Co_{30}Ni_{28}Si_2B_{16}$ | 13.0 | 1.11 | 16.2 | 330 | 0.017 | 0 | 11.4* | 7.4 |
| 14 | $Fe_{24}Co_{30}Ni_{27}Si_5B_{14}$ | 12.8 | 1.05 | 12.8 | 540 | 0.016 | 0 | 11.5# | 7.5 |
| 15 | $Fe_{24}Co_{30}Ni_{26}Si_9B_{11}$ | 12.8 | 0.99 | 9.4 | 1030 | 0.009 | 270 | 11.9 | 7.7 |
| 16 | $Fe_{32}Co_{10}Ni_{40}Si_2B_{16}$ | 16.7 | 1.02 | 9.1 | 1630 | 0.013 | 450 | 14.8 | 9.6 |
| 17 | $Fe_{34}Co_{15}Ni_{30}Si_1B_{20}$ | 15.6 | 1.07 | 8.6 | 1560 | 0.005 | 1100 | 13.7 | 8.9 |
| 18 | $Fe_{37}Co_3Ni_{40}Si_2B_{16}$ | 18.7 | 1.07 | 8.5 | 2090 | 0.004 | 1700 | 16 | 10 |
| 19 | $Fe_{38}Co_{15}Ni_{30}Si_1B_{16}$ | 22.4 | 1.24 | 15.2 | 860 | 0.001 | 4500 | 18 | 12 |
| 20 | $Fe_{41}Co_{16}Ni_{25}Si_2B_{16}$ | 23.5 | 1.29 | 14.5 | 980 | −0.009 | <0 | 18 | 12 |
| 21 | $Fe_{42}Ni_{40}Si_2B_{16}$ | 21.1 | 1.14 | 7.6 | 2920 | −0.001 | <0 | 17 | 11 |

TABLE I-continued

| Nr. | Alloy Composition (at %) | $\lambda_s$ (ppm) | $J_s$ (T) | $H_k(0)$ (Oe) | $\lvert df_r/dH \rvert$ (Hz/Oe) | $dH_k/d\sigma$ (Oe/MPa) | $\sigma$ (MPa) | $H_k(\sigma)$ (Oe) | $H_{max}$ (Oe) |
|---|---|---|---|---|---|---|---|---|---|
| 22 | $Fe_{46.5}Co_{31.5}Ni_5Si_1B_{16}$ | 34.5 | 1.61 | 18.0 | 1010 | −0.026 | $H_k$ is strongly reduced and | | |
| 23 | $Fe_{51}Co_2Ni_{30}Si_1B_{16}$ | 28.0 | 1.32 | 11.0 | 2080 | −0.016 | $\lvert df_r/dH \rvert$ is strongly enhanced | | |
| 24 | $Fe_{61.5}Co_{21.5}Si_1B_{16}$ | 42.4 | 1.73 | 12.7 | 2370 | −0.035 | by tensile stress | | |

*annealed for about 2s at 400° C.; # annealed for about 4s at 400° C.

All casts were prepared from ingots of at least 3 kg using commercially available raw materials. The ribbons used for the experiments were 6 mm wide and were either directly cast to their final width or slit from wider ribbons. The ribbons were strong, hard and ductile and had a shiny top surface and a somewhat less shiny bottom surface.

Annealing

The ribbons were annealed in a continuous mode by transporting the alloy ribbon from one reel to another reel through an oven in which a magnetic field was applied perpendicularly to the long ribbon axis.

The magnetic field was oriented either transversely to the ribbon axis, i.e. across the ribbon width according to the teachings of the prior art or, alternatively, the magnetic field was oriented such that it had a substantial component perpendicular to the ribbon plane. The latter technique is disclosed in detail in co-pending U.S. application Ser. No. 08/968,653 filed Nov. 12, 1997 ("Method of Annealing Amorphous Ribbons and Marker for Electronic Article Surveillance. G. Herzer"), assigned to the same assignee as the present application, the teachings of which are incorporated herein by reference, and provides the advantage of higher signal amplitudes. In both cases the annealing field is perpendicular to the long ribbon axis.

The magnetic field was produced in a 2.80 m long yoke by permanent magnets. Its strength was about 2.8 kOe in the experiments where the field was oriented essentially perpendicular to the ribbon plane and about 1 kOe in the set-up for "transverse" field annealing.

Although the majority of the examples given in the following were obtained with the annealing field oriented essentially perpendicular due the ribbon plane, the major conclusions apply as well to the conventional "transverse" annealing which was tested as well.

The annealing was performed in ambient atmosphere. The annealing temperature was chosen within the range from about 300° C. to about 420° C. A lower limit for the annealing temperature is about 300° C., which is necessary to relieve part of the production-inherent stresses and to provide sufficient thermal energy in order to induce a magnetic anisotropy. An upper limit for the annealing temperature results from the Curie temperature and the crystallization temperature. Another upper limit for the annealing temperature results from the requirement that the ribbon be ductile enough after the heat treatment to be cut into short strips. The highest annealing temperature is preferably lower than the lowest of the aforementioned material characteristic temperatures. Thus, typically, the upper limit of the annealing temperature is around 420° C.

The furnace used for the experiments was about 2.40 m long with a hot zone of about 1.80 m in length where the ribbon was subject to the aforementioned annealing temperature. The annealing speeds typically ranged from about 5 m/min to about 30 m/min, which correspond to annealing times from 22 sec down to about 4 sec, respectively.

The ribbon was transported through the oven in a straight path and was supported by an elongated annealing fixture in order to avoid bending or twisting of the ribbon due to the forces and the torque exerted on the ribbon by the magnetic field.

Testing

The annealed ribbon was cut to short pieces typically 38 mm long. These samples were used to measure the hysteresis loop and the magneto-elastic properties.

The hysteresis loop was measured at a frequency of 60 Hz in a sinusoidal field of about 30 Oe peak amplitude. The anisotropy field is the defined as the magnetic field $H_k$ at which the magnetization reached its saturation value. For an easy axis across the ribbon width the transverse anisotropy field is related to anisotropy constant $K_u$ by $$H_k = 2K_u/J_s$$

where $J_s$ is the saturation magnetization. $K_u$ is the energy needed per volume unit to turn the magnetization vector from the direction parallel to the magnetic easy axis to a direction perpendicular to the easy axis.

The magneto-acoustic properties such as the resonant frequency $f_r$ and the resonant amplitude A1 were determined as a function of a superimposed dc bias field H along the ribbon axis by exciting longitudinal resonant vibrations with tone bursts of a small alternating magnetic field oscillating at the resonant frequency with a peak amplitude of about 18 mOe. The on-time of the burst was about 1.6 ms with a pause of about 18 ms in between the bursts.

The resonant frequency of the longitudinal mechanical vibration of an elongated strip is given by $$f_r = \frac{1}{2L}\sqrt{E_H/\rho}$$

where L is the sample length, $E_H$ is Young's modulus at the bias field H and ρ is the mass density. For the 38 mm long samples the resonant frequency typically was in between about 50 kHz and 60 kHz depending on the bias field strength.

The mechanical stress associated with the mechanical vibration, via magnetoelastic interaction, produces a periodic change of the magnetization J around its average value $J_H$ determined by the bias field H. The associated change of magnetic flux induces an electromagnetic force (emf) which was measured in a close-coupled pickup coil around the ribbon with about 100 turns.

In the technology of electronic article surveillance, it is known that an item called a "marker" or "tag", which is affixed, for example, to an article of merchandise to prevent theft thereof, basically includes a housing containing a bias magnet and a "resonator." The resonator is or can be a suitably-sized piece of amorphous alloy produced in accordance with the method and apparatus of the present invention. In order to produce such a marker or tag, therefore, the method steps recited herein for annealing the "as cast" amorphous material are augmented by forming a resonator from "as cast" amorphous material by annealing the amorphous material and cutting the annealed amorphous material to a suitable size, and encapsulating the thus-formed resonator in a housing together with a deactivatable (degaussable) bias magnet.

In EAS systems the magneto-acoustic response of the marker is advantageously detected in-between the tone bursts, which reduces the noise level and thus, for example, allows wider gates to be built. The signal decays exponentially after the excitation, i.e. when the tone burst is over. The decay time depends on the alloy composition and the heat treatment and may range from about a few hundred microseconds up to several milliseconds. A sufficiently long decay time of at least about 1 ms is important to provide sufficient signal identity in between the tone bursts.

Therefore the induced resonant signal amplitude was measured about 1 ms after the excitation; this resonant signal amplitude will be referred to as A1 in the following. A high A1 amplitude as measured here, thus, is both an indication of good magneto-acoustic response and low signal attenuation at the same time.

Discussion of Results of Testing

FIG. 1 shows a typical linear hysteresis loop characteristic for an amorphous ribbon annealed in a magnetic field perpendicular to the long ribbon axis. The typical magneto-acoustic response for this ribbon is given in FIG. 2.

FIG. 1 shows a typical hysteresis loop for an amorphous ribbon annealed in a magnetic field perpendicular to the ribbon axis or annealed under the simultaneous presence of said magnetic field and a tensile stress along the ribbon axis. In this representation the magnetic field H has been normalized to the anisotropy field $H_k$ which defines the magnetic field at which the ribbon starts to be saturated magnetically. The particular example shown in FIG. 1 is an embodiment of this invention and corresponds to a 38 mm long, 6 mm wide and a 25 $\mu$m thick strip cut from an amorphous $Fe_{24}Co_{16}Ni_{42.5}Si_{1.5}B_{16}$ alloy ribbon continuously annealed with a speed of 20 m/min (annealing time about 5 s) at 380° C. under the simultaneous presence of a magnetic field of 2.8 kOe oriented essentially perpendicular to the ribbon plane and a tensile stress of about 90 MPa.

Figure 2:
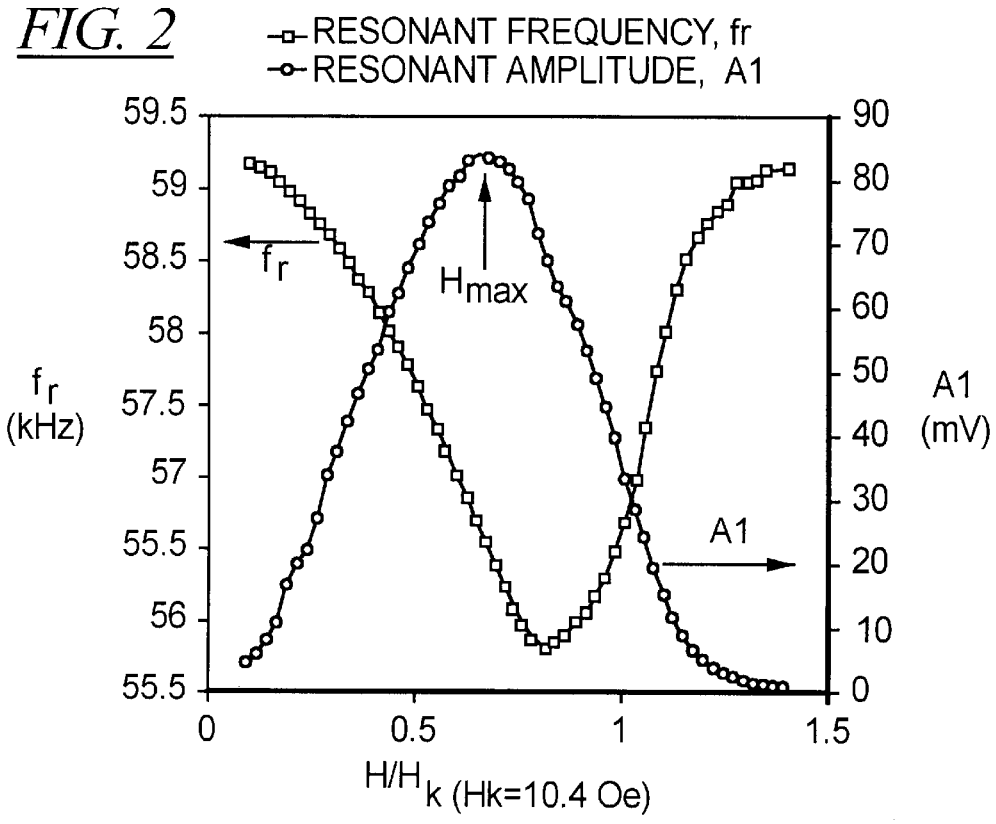
FIG. 2 illustrates the typical behavior of the resonant frequency $f_r$ and the resonant amplitude A1 as a function of a magnetic bias field H for an amorphous magnetostrictive ribbon annealed in a magnetic field oriented perpendicularly to the ribbon axis, or annealed under the simultaneous presence of such a magnetic field and a tensile strength along the ribbon axis.

FIG. 2 shows the typical behavior of the resonant frequency $f_r$ and the resonant amplitude A1 as a function of a magnetic bias field H for an amorphous magnetostrictive ribbon annealed in a magnetic field perpendicular to the ribbon axis or annealed under the simultaneous presence of said magnetic field and a tensile stress along the ribbon axis. In this representation the magnetic field H has been normalized to the anisotropy field $H_k$ which defines the magnetic field at which the ribbon starts to be saturated magnetically. The particular example shown in FIG. 2 is an embodiment of this invention and corresponds to a 38 mm long, 6 mm wide and a 25 $\mu$m thick strip cut from an amorphous $Fe_{24}Co_{16}Ni_{42.5}Si_{1.5}B_{16}$ alloy ribbon continuously annealed with a speed of 20 m/min (annealing time about 5 s) at 380° C. under the simultaneous presence of a magnetic field of 2.8 kOe oriented essentially perpendicular to the ribbon plane and a tensile stress of about 90 MPa.

FIGS. 1 and 2 illustrate the basic mechanisms affecting the magneto-acoustic properties of a resonator. Thus, the variation of the resonant frequency $f_r$ with the bias field H, as well as the corresponding variation of the resonant amplitude A1 is strongly correlated with the variation of the saturation polarization J with the magnetic field. Accordingly, the bias field $H_{min}$ where $f_r$ has its minimum is located close to the anisotropy field $H_k$. Moreover, the bias field $H_{max}$ where the amplitude is maximum also correlates with the anisotropy field $H_k$; typically we found $H_{max} \approx 0.65 (\pm 0.15) H_k$.

Thus, as a first conclusion, the anisotropy field $H_k$ should be chosen (by means of alloy composition and heat treatment) so that it is about 1.5 times larger than the typical bias fields which are applied to the resonator in operation. This guarantees a maximum signal amplitude. Generally bias fields lower than about 8 Oe are preferable since this reduces energy consumption if said bias fields are generated with an electrical current by field coils. If the bias field is generated by a magnetic strip adjacent to the resonator, the necessity for low bias fields arises from the requirement of low magnetic clamping of the resonator and the bias magnet as well as from the economical requirement to build the bias magnet with a small amount of material. As a consequence the anisotropy field of the resonator should not exceed $H_k \approx 13$ Oe.

A particular demand for EAS markers moreover is that the resonant frequency in the activated state (i.e. when the bias magnet is magnetized) vary as little as possible with the applied field —a typical requirement, e.g., is that the change of the resonant frequency with the bias field, i.e. $|df_r/dH|$ is less than about 700 Hz/Oe.

The resonant frequency $f_r$ can reasonably well be described as a function of the bias field H by $$f_r(H) = \frac{f_r(H=0)}{\sqrt{1 + \frac{9\lambda_s^2 E_s}{J_s H_K^3} H^2}}$$

where $\lambda_s$ is the saturation magnetostriction constant, $J_s$ is the saturation magnetization, $E_s$ is Young's modulus in the ferromagnetically saturated state and $H_k$ is the anisotropy field. Using this relationship, then $$\left|\frac{df_r}{dH}\right| = f_r H \frac{9\lambda_s^2 E_s}{J_s H_K^3} \Big/ \left(1 + \frac{9\lambda_s^2 E_s}{J_s H_K^3} H^2\right) \sim f_r H \frac{9\lambda_s^2 E_s}{J_s H_K^3}$$

From this the inventors have concluded, as evidenced by the examples in Table I, that $|df_r/dH|$ generally increases when the saturation magnetostriction $\lambda_s$ increases and the anisotropy $H_k$ decreases, respectively, and vice versa.

Both the saturation magnetostriction and the anisotropy field depend on the alloy composition. $H_k$, however, additionally depends on the annealing parameters and, due to demagnetizing effects, on the geometry of the resonator. Accordingly, in order to obtain an optimized resonator for an EAS marker one must find a well-defined combination of alloy composition and heat treatment for a given resonator geometry.

As shown in Table I there is clearly a relatively narrow range of compositions which fulfill the requirement for an optimized resonator, i.e. a slope $|df_r/dH| < 700$ Hz/Oe at the bias where the amplitude has its maximum. In particular, if the field-annealing is performed without or only small tension, these suitable alloys exhibit a relatively high Co-content of about 20 at % and more.

When the Co-content is reduced the slope $|df_r/dH|$ significantly increases above the permissible value of 700 Hz/Oe. Typically, the alloys with a Co-content significantly lower than about 20 at % readily exhibit a slope of 1000 Hz/Oe and more. In order to reduce such high slopes down to the desired value typically requires an increase of the induced anisotropy field of the alloys by at least about 2–3 Oe.

Figure 3:
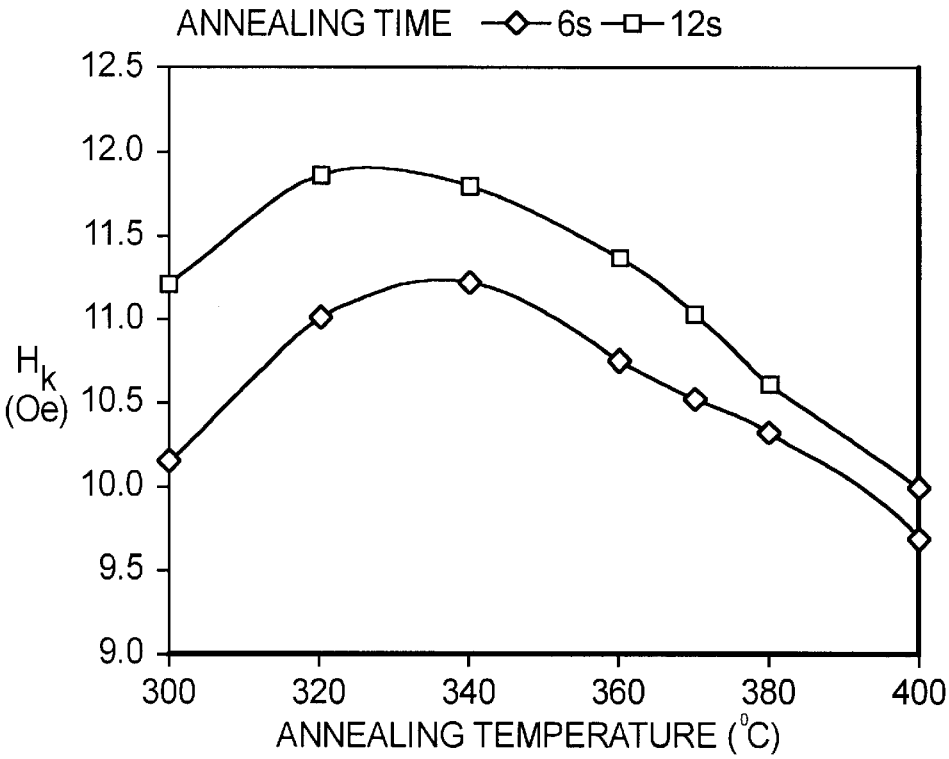
FIG. 3 shows the typical variation of the magnetic field induced anisotropy field $H_k$ as a function of the annealing temperature and annealing time. The particular examples shown in FIG. 3 are for a 38 mm long, 6 mm wide and a 25 $\mu$m thick strip cut from an amorphous $Fe_{24}Co_{18}Ni_{40}Si_2B_{16}$ alloy ribbon continuously annealed in a magnetic field of 2 kOe oriented essentially perpendicular to the ribbon plane.

FIG. 3 shows a typical example how the anisotropy field varies with the annealing time and annealing temperature. This example shows that the anisotropy field $H_k$ can be maximized by increasing the annealing time (i.e. decreasing the annealing speed) and choosing an appropriate annealing temperature. The examples given in Table I were annealed for about 6 s (18 m/min) at about 360° C. which is already relatively close to the maximum $H_k$ (minimum slope) obtainable at this short annealing time. A significant increase of $H_k$ by only about 1 Oe already requires twice the annealing time, i.e. half the annealing speed. However, for economical reason high annealing speeds above about 10 m/min are highly desirable.

The inventors have found that a very effective means in order to increase the anisotropy field of the low Co alloys, and hence to reduce the slope $|df_r/dH|$, is to apply a tensile stress during annealing.

Figure 4:
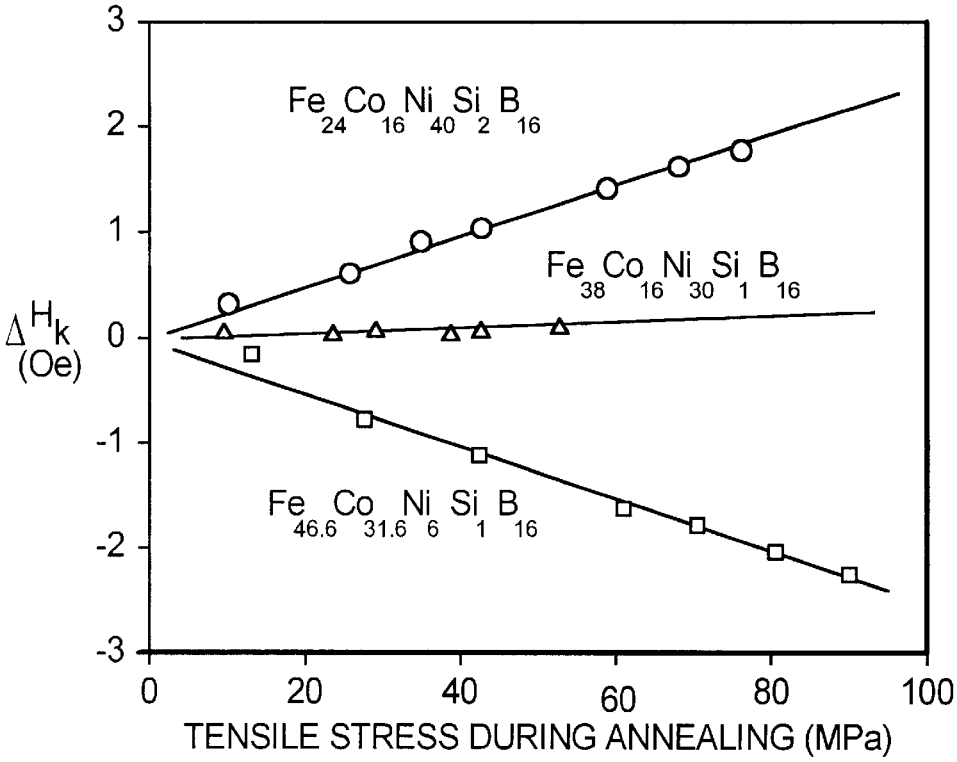
FIG. 4 shows the change of the induced anisotropy field $\Delta H_k$ as a function of the tensile stress applied during annealing in a magnetic field perpendicular to the ribbon axis for three amorphous (Fe, Co, Ni)-alloys with different iron contents.

FIG. 4 shows the change of the resonator anisotropy field as a function of the tensile stress under which the ribbon was annealed. FIG. 4 demonstrates that the change of the anisotropy field $H_k$ with the annealing stress a is highly sensitive to the choice of the alloy composition.

The variation of $H_k$ with annealing stress $\sigma$ is essentially linear; i.e.

$$\Delta H_k = \frac{dH_k}{d\sigma}\sigma$$

where $dH_k/d\sigma$ is mainly determined by the alloy composition and to some extent by the annealing time and temperature. Table I, in terms of the parameter $dH_k/d\sigma$, gives further examples how the anisotropy field changes for the various compositions when the annealing is performed under a tensile stress along the ribbon axis.

A closer analysis of $dH_k/d\sigma$ as a function of the composition shows that in particular those compositions with an Fe content lower than about 30 at % and/or a magnetostriction smaller than about 15 ppm reveal a significant increase of the anisotropy field when being stress annealed. Examples of such inventive compositions are the alloys Nr. 1 to 15 listed in Table I.

The stress annealing effect is particular useful for the compositions with a Co-content equal or less than about 18 at % (alloys Nr. 1 to 9 in Table I) to reduce the slope below the required limit of 700 Hz/Oe. Table I additionally lists the tensile stress necessary for these alloys to decrease the slope to about 650 Hz/Oe. Thus, for example, an anneal treatment with a tensile stress of at least about 100 MPa allows the Co-content to be reduced by about 3–5 at % compared to an identical heat treatment but without tensile stress. The Co-content can be even further reduced up to about 10 at % when then tensile stress is increased to about 200–300 MPa. The table also lists the anisotropy field $H_k(\sigma)$ after such a stress-anneal treatment and the bias field $H_{max}$ where the signal amplitude is maximum. Accordingly, the anisotropy field is still low enough to operate the marker at reasonably low bias fields below about 8 Oe, but on the other hand $H_k$ is high enough to guarantee a low slope.

The magnetic field/tensile stress annealed sample exhibits a highly linear hysteresis loop similar to the samples annealed in a magnetic field only. This is demonstrated in FIG. 1 which actually shows the loop of such a field/stress annealed sample. This is an important aspect with respect to avoiding false alarms in harmonic systems.

The alloys with higher Co-content (alloys nos. 10 to 14) already exhibit a sufficiently low slope without tensile stress. Still, applying a tensile stress when annealing these alloys allows the annealing speed to be increased dramatically.

As for the higher Co-content alloys only Nr. 15 exhibits a high slope. This is obviously associated with its high Si-content. The inventors have thus concluded that for reducing the slope at reduced Co-content it is advantageous to replace the Si-content with boron and to limit the Si-content to a few atomic percent only. For the same reasons it is advantageous to keep the total concentration of the non-magnetic glass forming elements like Si, B, C, Nb, Mo and others below a total concentration of about 20 at %. On the other hand these elements are needed for glass formation and, therefore, should form a portion of a least about 14 at %.

Alloys Nr. 16–21 are comparative examples which are out of the scope of the present invention. These are alloys less suited for a optimized marker because they exhibit a high slope at the maximum signal resonator amplitude and because they are relatively insensitive to stress annealing. Due to this insensitivity, the high slope cannot be reduced by stress annealing because the required stress level is hardly feasible. Thus, in practice, the ribbon tends to break when the stress exceeds about 500 MPa and definitely breaks when the stress approaches the yield strength which for amorphous ribbons is in between 1000–2000 MPa depending on the ribbon quality. Moreover alloys Nr. 20 and 21 would require large negative stress which cannot be realized. Thus, the values of $H_k(\sigma)$, $H_{max}$ and $\sigma$ listed in Table I are only hypothetical. Even if we could realize the anisotropy field $H_k(\sigma)$ necessary to reduce the $f_r$ slope below about 700 Hz/Oe the bias field $H_{max}$ where the resonator amplitude has its maximum would be higher than the admissible 8 Oe.

Further Examples

The following summarizes a series of annealing experiments performed in each case in a furnace with a nominal 1.8 m long temperature profile of about 380° C. The annealing speed was adjusted such that the 38 mm long, 6 mm wide and typically 25 $\mu$m thin resonator revealed a slope of $|dfr/dH| \approx 600$–640 Hz/Oe at a bias of 6.5 Oe and a frequency shift of more than 1.9 kHz when said bias is removed. The latter is important for a proper deactivation of the tag.

In a first experimental series the alloy composition was $Fe_{24}Co_{18}Ni_{40}Si_2B_{15.5}C_{0.5}$ and the annealing was performed in a magnetic field of 1 kOe oriented across the ribbon width. The desired resonator properties were achieved with an annealing speed of 12 m/min. The average signal amplitude A1 at 6.5 Oe was about 73 mV.

In a second experimental series the same alloy composition was annealed in a magnetic field of 1 kOe oriented across the ribbon width, but this time with a tensile stress of about 40 MPa along the ribbon axis. The desired resonator properties were this time achieved with a considerably higher annealing speed of 20 m/min.

In a third experimental series the same alloy composition was again annealed but this time in a magnetic field of 2.8 kOe applied essentially perpendicular to the ribbon plane. The ribbon was guided through the furnace by an annealing fixture in order to prevent the ribbon being rotated parallel to the magnetic field lines by the torque of the magnetic field. As a consequence the ribbon is pressed against the annealing fixture. The resulting friction between annealing fixture and the ribbon results in a tensile stress along the ribbon axis which is about 120 MPa when being measured at the end of said fixture, however, since this stress is built up along the annealing fixture only about one half of it is effective for inducing an anisotropy. This effective value is further reduced since only part of the fixture is at the annealing temperature. The stress level effective for the stress induced anisotropy was estimated to be about 50 MPa.

Due to this tensile stress the desired resonator properties again could be achieved at a high annealing speed annealing speed of 20 m/min. Apart from the higher annealing speed the additional advantage of the "perpendicular" field was a significantly higher resonant amplitude of about 85 mV.

In a fourth experimental series the alloy composition was $Fe_{24}Co_{16}Ni_{42.5}Si_{1.5}B_{15.5}C_{0.5}$, i.e., with about 2 at % less Co than in the aforementioned experiments. The annealing was again done in a magnetic field of 2.8 kOe applied essentially perpendicular to the ribbon plane. Additionally an external tensile force of about 6 N was applied along the ribbon, which corresponds to a tensile stress of about 40 MPa. Together with the tensile stress produced by the annealing fixture this yields a total effective annealing stress of about 90 MPa. Again the desired resonator properties were achieved at the high annealing speed of 20 m/min although the alloy had 2 at % less Co. Similarly the resonant amplitude stayed at the high level of about 85 mV.

In a fifth and sixth experimental series the Co-content was further be reduced by using the compositions $Fe_{24}Co_{15}Ni_{43.5}Si_{1.5}B_{15.5}C_{0.5}$ and $Fe_{24}Co_{14}Ni_{44.5}Si_{1.5}B_{15.5}C_{0.5}$. The annealing was again performed in a magnetic field of 2.8 kOe applied essentially perpendicularly to the ribbon plane. Despite the reduced Co-content the desired resonator properties could again be achieved at a high annealing speed of 20 m/min by just increasing the tensile stress to total effective values of about 120 and 160 MPa, respectively.

In further experiments it was verified that the annealing speed could be further increased to about 30 m/min and more by just increasing the applied tensile stress.

The experiments indicate that also further reduction of the Co-content down to 10 at % or below is possible by just increasing the tensile stress further. Such examples are listed in Table I.

These experimental series demonstrate again that applying a tensile stress during annealing reduces the Co-content of the alloy and/or increasing the annealing speed, and thus can reduce raw material, production and investment cost considerably, resulting in a less expensive resonator.

Consistency of the Resonator Properties

For this series of experiments several reels with about 2000 meters of a 6 mm wide $Fe_{24}Co_{16}Ni_{42}Si_2B_{16}$ alloy were selected which exhibited thickness fluctuations between about 20 $\mu$m to 30 $\mu$m. The annealing was performed in a magnetic field in a furnace with a nominal 1.8 m long temperature profile of about 380° C. In a first series of experiments, the magnetic field was oriented across the ribbon width and, in a second series, perpendicularly to the ribbon plane. The conclusions are the same for both directions of field orientation. The annealing speed was adjusted such that the 37.4 mm long, 6 mm wide and typically 25 $\mu$m thin resonator exhibited a slope of $|df_r/dH| \approx 600$–640 Hz/Oe at a bias of 6.5 Oe, a resonant frequency of 58.0 kHz at this bias, and a frequency shift of more than 1.9 kHz when this bias is removed. Furthermore an annealing fixture was used in both cases to give the ribbon a transverse curl of about 230 $\mu$m. After annealing the resonator properties were tested throughout the length of the reel.

In a first experiment a conventional anneal according to the prior art was conducted with fixed annealing conditions and with nominally zero applied tensile stress. The annealing speed was about 8 m/min which yields the desired resonator properties for a 25 $\mu$m thick ribbon, however, the resonator properties proved to be fairly inconsistent along the reel. Thus, for example the resonant frequency varied by about 600 Hz, i.e., about from 57.70 kHz for the thin ribbon portions, to about 58.3 kHz for the thick ribbon portions. This variation, as a consequence reduces the pick-rate of an EAS marker considerably, since the resonant amplitude of the resonator drops significantly if its resonant frequency deviates from the frequency emitted by the transmitter electronics. Similarly the frequency slope varied from about 720 Hz/Oe for the thin ribbon portions to about 530 Hz/Oe for the thick ribbon portions; the frequency shift upon removing the bias magnetic field varied between about 2.15 kHz (thin ribbon portions) to 1.58 kHz (thick ribbon portions). Additionally, the amplitude dropped by about 10% for the thicker ribbon portions. These variations reduce the performance of an EAS marker, since (1) the thinner ribbon portions tend to become too sensitive to variations of the bias field and (2) the thicker ribbon portions have a reduced signal amplitude and may not be deactivated properly when the bias magnet is removed due to the reduced frequency shift.

In a second experiment the annealing speed was 20 m/min and an average tensile stress of about 85 N was applied. The tensile stress was adjusted to the actual thickness of that part of the ribbon which passed through the oven. For this purpose the thickness and anisotropy field $H_a$ of the annealed ribbon were measured continuously after the ribbon exited the oven. During the $H_a$ measurement the ribbon was subjected to no tensile stress, this being achieved by a dead loop located before the measurement. In the next step the demagnetizing field $H_{demag}$ of a 37.4 mm long and 6 mm wide resonator was calculated from the measured thickness and added to the measured anisotropy field, i.e.

$$H_k = H_a + H_{demag}$$

This demagnetizing field $H_{demag}$ is proportional to the ribbon thickness. The tension was then adjusted such that the calculated $H_k$ remained constant throughout the annealing process during which the ribbon thickness varied between about 20 $\mu$m and 30 $\mu$m. In order to compensate the thickness fluctuations, the tensile force varied between about 65 MPa (for the thick ribbon) and about 105 MPa (for the thin ribbon). All the measurements, data evaluations as well as the feedback control of the applied tensile force were conducted by a personal computer. This time the resonant frequency was extremely consistent throughout the reel and showed more than an order of magnitude less scatter (i.e. about ±30 Hz only) than in the first experiment where no feedback control was applied. Similarly the slope was 620 Hz/Oe within a narrow band of ±20 Hz/Oe, the frequency shift upon removal of the bias was about 2.1 kHz within a narrow band of 0.05 kHz, the signal amplitude was about 71 mV for the transverse field annealed and about 84 mV for the perpendicular field annealed ribbon, respectively, and within about 2% showed a very consistent level.

In a third comparative experiment the feedback control was accomplished by varying the annealing speed instead of the tension. The annealing was again performed at nominally zero tensile stress at a speed of about 8 m/min. As a result the annealing process slowed extremely for the thin ribbon, to less than about 4 m/min. For the thick ribbon the speed increased to about 16 m/min. Again the resonant frequency and the slope were rather consistent throughout the reel, however, the transverse curl showed an pronounced variation from about 100 $\mu$m at the high annealing speeds, up to almost 400 $\mu$m for the slow speed. This was unlike the tension-controlled experiment where the transverse curl exhibited only minor variations within about ±50 $\mu$m.

An alternative feedback technique could be to correct the magnetic properties by adjusting the temperature, however, this would produce a relatively slow process and would require the construction of special, very quickly reacting furnace in terms of producing rapid temperature changes. Furthermore the curl is very susceptible to the annealing temperature, and thus would again show large variations.

Only the tension-controlled feedback process appears to offer a unique opportunity to achieve extremely consistent resonator properties.

The resonator properties not only are very susceptible to the ribbon thickness but also to the chemistry of the amorphous alloy. The accuracy of alloying as well as the accuracy of chemical analysis typically is about ±0.5 at %. As a consequence, if annealed at fixed annealing conditions the resonators from different melts may exhibit variations in their resonant frequency of about than ±100 Hz or more, of about ±100 Hz/Oe in their frequency slope and of about ±0.3 kHz in their frequency shift upon deactivation. Together with the susceptibility of the resonator properties to the thickness, this yields an inconsistency in the resonator properties which is unacceptable for good EAS markers. Conventional methods of overcoming this scatter are (1) extremely low tolerances in alloy chemistry, the ribbon thickness and the annealing conditions and/or (2) extensive pre-testing in order to adjust the annealing parameters for each individual melt and/or reel. The inventive feedback control overcomes these difficulties easily and guarantees consistent resonator properties in a most economic way.

Although the above examples have been described in the context of amorphous ribbon, or pieces or strips cut from amorphous ribbon, the method and apparatus described above can also be employed to anneal amorphous wire, such as amorphous wire having a diameter between about 20 $\mu$m and 150 $\mu$m, with substantially the same advantages of increased throughput speed and lower material cost as described above, and with the resulting annealed wire having magnetic properties substantially as described above. In the case of amorphous wire, the concept of a "ribbon plane" is obviously no longer applicable to define the "out of the plane" perpendicular magnetic field orientation. In the case of amorphous wire, therefore, the perpendicularly oriented, or substantially perpendicularly oriented, magnetic field applied during annealing is perpendicular to the longitudinal axis of the wire, and substantially perpendicular to a transverse plane passing through a center of the wire.

High Iron Content Alloys

A pre-condition for the above-described tension-controlled feedback is that the anisotropy of the material be susceptible to tensile stress during annealing. Of course, this is not limited to the case where the tensile stress produces a magnetic hard ribbon axis but works as well if the stress induced anisotropy results in a magnetic easy ribbon axis. What is important is that the tensile stress is capable of inducing a large change of the total anisotropy. This is also the case if the iron content of the alloy exceeds about 45 at % where the anisotropy is considerably decreased when being annealed under tensile stress. Alloys Nos. 22 through 24 in Table I are some representative examples of such alloy compositions with more than 45 at % Fe which are another embodiment of this invention.

Although these alloys are less suited for the above described EAS system, they may be well-suited for magnetoelastic identification systems which require the capability of producing a large change of Young's modulus with the applied field (i.e. a large value of $|df_r/dH|$) and correspondingly a small anisotropy field. Thus, in this particular case, it is advantageous to have an alloy composition where stress annealing results in a magnetic easy ribbon axis i.e. where $|df_r/dH|$ is enhanced by stress annealing.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for annealing an amorphous alloy article comprising the steps of:

(a) providing an unannealed amorphous alloy article having an alloy composition and a longitudinal axis;

(b) disposing said amorphous alloy article in a zone of elevated temperature while subjecting said amorphous alloy article to tensile stress along said longitudinal axis and while subjecting said amorphous alloy article to a magnetic field oriented substantially perpendicularly to said longitudinal axis, to produce an annealed amorphous alloy article having a plurality of characteristics;

(c) selecting said alloy composition to comprise iron, cobalt and nickel having an iron content of more than about 15 at % and less than about 30 at % so that the annealed amorphous alloy article has, among said characteristics, an induced magnetic easy plane perpendicular to said longitudinal axis due to said tensile stress which is superimposed to the magnetic easy axis direction induced by said magnetic fields;

(d) monitoring at least one of said characteristics of said annealed amorphous alloy article upon exiting said zone of elevated temperature; and (e) adjusting said tensile stress to which said amorphous alloy article is subjected in said zone of elevated temperature dependent on the final characteristic which is monitored.

2. A method as claimed in claim 1 wherein step (a) comprises providing a continuous, unannealed amorphous alloy ribbon as said unannealed amorphous alloy article, and wherein step (b) comprises continuously transporting said amorphous alloy ribbon through said zone of elevated temperature.

3. A method as claimed in claim 2 wherein step (c) wherein said zone of elevated temperature has a temperature of at least 300° C., and comprising transporting said continuous amorphous alloy ribbon through said zone of elevated temperature at a speed of at least 15 m/min.

4. A method as claimed in claim 1 wherein said amorphous alloy article has a transverse plane associated therewith, and wherein step (b) comprises subjecting said amorphous alloy article to said magnetic field oriented substantially perpendicularly to said longitudinal axis and oriented with a substantial component perpendicular to said transverse plane and having a magnitude of at least 2 kOe.

5. A method as claimed in claim 1 comprising annealing said amorphous alloy article in step (b) and selecting said alloy composition in step (c) for producing an annealed amorphous alloy article having a magnetic behavior characterized by a hysteresis loop which is linear up to a magnetic field which ferromagnetically saturates said annealed amorphous alloy article.

6. A method as claimed in claim 1 wherein step (c) comprises selecting said amorphous alloy composition as comprising $Fe_aCo_bNi_cSi_xB_yM_z$, wherein a, b, c, x, y and z are in at %, wherein M is at least one element selected from the group consisting of C, P, Ge, Nb, Ta, Mo, Cr and Mn, wherein a ranges from about 15 to about 30, b ranges from 0 to about 30, c ranges from about 15 to about 55, x ranges from about 0 to about 10, y ranges from about 10 to about 25, z ranges from about 0 to about 5, x+y+z ranges from about 14 to about 25, and a+b+c+x+y+z=100.

7. A method as claimed in claim 1 wherein step (c) comprises selecting said amorphous alloy composition as comprising $Fe_aCo_bNi_cSi_xB_yM_z$, wherein a, b, c, x, y and z are in at %, wherein M is at least one element selected from the group consisting of C, P, Ge, Nb, Ta, Mo, Cr and Mn, wherein a ranges from about 15 to about 30, b ranges from 5 to about 18, c ranges from about 32 to about 55, x ranges from about 0 to about 6, y ranges from about 12 to about 20, z ranges from about 0 to about 3, x+y+z ranges from about 14 to about 20, and a+b+c+x+y+z=100.

8. A method as claimed in claim 1 wherein step (c) comprises selecting said alloy composition from the group consisting of $Fe_{24}Co_{18}Ni_{40}Si_2B_{16}$, $Fe_{24}Co_{16}Ni_{42.5}Si_{1.5}B_{16}$, $Fe_{24}Co_{15}Ni_{43.5}Si_{1.5}B_{16}$, $Fe_{24}Co_{14}Ni_{44.5}Si_{1.5}B_{16}$, $Fe_{24}Co_{13}Ni_{46}Si_1B_{16}$ and $Fe_{25}Co_{10}Ni_{48}Si_1B_{16}$, wherein the subscripts are in at % and wherein up to 1.5 at % of B can be replaced by C.

9. A method as claimed in claim 1 wherein (a) comprises providing an unannealed amorphous alloy ribbon as said amorphous alloy article, having a thickness between about 15 μm and about 40 μm, and wherein step (c) comprises selecting said alloy composition so that said annealed amorphous alloy article has a ductility allowing said annealed amorphous alloy article to be cut into pieces having a width between about 1 mm and about 14 mm.

10. A method as claimed in claim 1 wherein step (b) comprises subjecting said amorphous alloy article to tensile stress in a range between 10 MPa to about 400 MPa.

11. A method for manufacturing a marker for an electronic article surveillance system comprising the steps of:

(a) providing an unannealed amorphous alloy article having an alloy composition and a longitudinal axis;

(b) disposing said amorphous alloy article in a zone of elevated temperature while subjecting said alloy article to tensile stress along said longitudinal axis and while subjecting said amorphous alloy article to a magnetic field oriented substantially perpendicularly to said longitudinal axis, to produce an annealed amorphous alloy article having a plurality of characteristics;

(c) selecting said alloy composition to comprise iron, cobalt and nickel with an iron content of more than 15 at % and less than 30 at %, and so that the annealed amorphous alloy article has, among said characteristics, an induced magnetic easy plane perpendicular to said longitudinal axis due to said tensile stress which is superimposed to the magnetic easy axis direction inducted by said magnetic field;

(d) monitoring at least one of said characteristics of said annealed amorphous alloy article upon exiting said zone of elevated temperature;

(e) adjusting said tensile stress to which said amorphous alloy article is subjected in said zone of elevated temperature dependent on the final characteristic which is monitored;

(f) providing a demagnetizable ferromagnetic element which produces a magnetic bias field;

(g) cutting a piece of said annealed amorphous alloy article to form a resonator; and (f) enclosing said resonator and said ferromagnetic element in a housing with said resonator disposed in said magnetic bias field.

12. A method as claimed in claim 11 wherein step (a) comprises providing a continuous, unannealed amorphous alloy ribbon as said unannealed amorphous alloy article, and wherein step (b) comprises continuously transporting said amorphous alloy ribbon through said zone of elevated temperature.

13. A method as claimed in claim 12 wherein step (c) wherein said zone of elevated temperature has a temperature of at least 300° C., and comprising transporting said continuous amorphous alloy ribbon through said zone of elevated temperature at a speed of at least 15 m/min.

14. A method as claimed in claim 11 wherein said amorphous alloy article has a transverse plane associated therewith, and wherein step (b) comprises subjecting said amorphous alloy article to said magnetic field oriented substantially perpendicularly to said longitudinal axis and oriented with a substantial component perpendicular to said transverse plane and having a magnitude of at least 2 kOe.

15. A method as claimed in claim 11 comprising annealing said amorphous alloy article in step (b) and selecting said alloy composition in step (c) for producing an annealed amorphous alloy article having a magnetic behavior characterized by a hysteresis loop which is linear up to a magnetic field which ferromagnetically saturates said annealed amorphous alloy article.

16. A method as claimed in claim 11 wherein step (c) comprises selecting said amorphous alloy composition as comprising $Fe_aCo_bNi_cSi_xB_yM_z$, wherein a, b, c, x, y and z are in at %, wherein M is at least one element selected from the group consisting of C, P, Ge, Nb, Ta, Mo, Cr and Mn, wherein a ranges from about 15 to about 30, b ranges from 0 to about 30, c ranges from about 15 to about 55, x ranges from about 0 to about 10, y ranges from about 10 to about 25, z ranges from about 0 to about 5, x+y+z ranges from about 14 to about 25, and a+b+c+x+y+z=100.

17. A method as claimed in claim 11 wherein step (c) comprises selecting said amorphous alloy composition as comprising $Fe_aCo_bNi_cSi_xB_yM_z$, wherein a, b, c, x, y and z are in at %, wherein M is at least one element selected from the group consisting of C, P, Ge, Nb, Ta, Mo, Cr and Mn, wherein a ranges from about 15 to about 30, b ranges from 5 to about 18, c ranges from about 32 to about 55, x ranges from about 0 to about 6, y ranges from about 12 to about 20, z ranges from about 0 to about 3, x+y+z ranges from about 14 to about 20, and a+b+c+x+y+z=100.

18. A method as claimed in claim 11 wherein step (c) comprises selecting said alloy composition from the group consisting of $Fe_{24}Co_{18}Ni_{40}Si_2B_{16}$, $Fe_{24}Co_{16}Ni_{42.5}Si_{1.5}B_{16}$, $Fe_{24}Co_{15}Ni_{43.5}Si_{1.5}B_{16}$, $Fe_{24}Co_{14}Ni_{44.5}Si_{1.5}B_{16}$, $Fe_{24}Co_{13}Ni_{46}Si_1B_{16}$ and $Fe_{25}Co_{10}Ni_{48}Si_1B_{16}$, wherein the subscripts are in at % and wherein up to 1.5 at % of B can be replaced by C.

19. A method as claimed in claim 11 wherein (a) comprises providing an unannealed amorphous alloy ribbon as said amorphous alloy article, having a thickness between about 15 μm and about 40 μm, and wherein step (c) comprises selecting said alloy composition so that said annealed amorphous alloy article has a ductility allowing said annealed amorphous alloy article to be cut into pieces having a width between about 1 mm and about 14 mm.

20. A method as claimed in claim 11 wherein step (b) comprises subjecting said amorphous alloy article to tensile stress in a range between 10 MPa to about 400 MPa.

21. A method as claimed in claim 11 wherein step (a) comprises providing an unannealed continuous amorphous alloy ribbon as said unannealed amorphous alloy article, said ribbon having a thickness between about 15 μm and about 40 μm, and wherein step (g) comprises cutting a strip from said ribbon having a length so that said resonator exhibits mechanical resonance at a resonant frequency determined by said length, said magnetic bias field, said alloy composition, and step (b).

22. A method as claimed in claim 21 wherein step (g) comprises cutting a plurality of strips of equal length from said continuous amorphous alloy ribbon after annealing, said plurality of strips exhibiting an average resonant frequency and, for a given magnetic bias field produced by said ferromagnetic element, each of said plurality of strips having a respective resonant frequency having a mean square root deviation from said average resonant frequency of less than 0.3%.

23. A method as claimed in claim 21 wherein step (g) comprises cutting said strip to a length between about 36.5 mm and about 38.5 mm so that said resonator has a resonant frequency of 58 kHz at a bias field of 6.5 Oe.

24. A method as claimed in claim 21 wherein said resonator has a resonant amplitude with a maximum at a bias field below about 8 Oe.

25. A method as claimed in claim 21 wherein step (g) comprises cutting a strip so that said resonator has a resonant frequency in said magnetic bias field which changes by less than 700 Hz/Oe at a strength of said magnetic bias field at which a resonant amplitude of said resonator has a maximum.

26. A method as claimed in claim 21 wherein step (g) comprises cutting a strip so that said resonator has a change in said resonant frequency of less than 700 Hz/Oe when said bias field has a value of 6.5 Oe.

27. A method as claimed in claim 26 wherein step (g) comprises cutting a strip so that said resonator has a resonant frequency which is more than 1.6 kHz when said ferromagnetic element is demagnetized and said magnetic bias field is thereby removed.

28. A method as claimed in claim 26 wherein step (a) comprises providing said unannealed continuous amorphous alloy ribbon having thickness of less than 30 $\mu$m, and wherein step (g) comprises cutting said strip to a width of less than 8 mm.

29. A method as claimed in claim 21 wherein step (g) comprises cutting a strip to a length between 9 mm and about 12 mm to produce a resonator having a resonant frequency of about 200 kHz when said ferromagnetic element is demagnetized and said magnetic bias field is thereby removed.

30. A method as claimed in claim 29 wherein step (g) comprises cutting said strip to have a width of less than about 2 mm.

31. A method for annealing an amorphous alloy article comprising the steps of:

(a) providing an unannealed amorphous alloy article having an alloy composition and a longitudinal axis;

(b) disposing said amorphous alloy article in a zone of elevated temperature while subjecting said amorphous alloy article to tensile stress along said longitudinal axis and while subjecting said amorphous alloy article to a magnetic field oriented substantially perpendicularly to said longitudinal axis, to produce an annealed amorphous alloy article having a plurality of characteristics; and (c) selecting said alloy composition to comprise iron with an iron content of more than about 45 at %, so that the annealed amorphous alloy article has, among said characteristics, a substantial change of Young's modulus in the presence of a magnetic bias field;

(d) monitoring at least one of said characteristics of said annealed amorphous alloy article upon exiting said zone of elevated temperature; and (e) adjusting said tensile stress to which said amorphous alloy article is subjected in said zone of elevated temperature dependent on the final characteristic which is monitored.

32. A method as claimed in claim 31 wherein step (a) comprises providing a continuous, unannealed amorphous alloy ribbon as said unannealed amorphous alloy article, and wherein step (b) comprises continuously transporting said amorphous alloy ribbon through said zone of elevated temperature.

33. A method as claimed in claim 32 wherein step (c) wherein said zone of elevated temperature has a temperature of at least 300° C., and comprising transporting said continuous amorphous alloy ribbon through said zone of elevated temperature at a speed of at least 15 m/min.

34. A method as claimed in claim 31 wherein step (c) comprises selecting said amorphous alloy composition as comprising $Fe_aCo_bNi_cSi_xB_yM_z$, wherein a, b, c, x, y and z are in at %, wherein M is at least one element selected from the group consisting of C, P, Ge, Nb, Ta, Mo, Cr and Mn, wherein a ranges from about 45 to about 86, b ranges from 0 to about 40, c ranges from about 0 to about 50, x ranges from about 0 to about 10, y ranges from about 10 to about 25, z ranges from about 0 to about 5, x+y+z ranges from about 14 to about 25, and a+b+c+x+y+z=100.

* * * * *